US005987054A

United States Patent [19]

Fishman et al.

[11] Patent Number: 5,987,054

[45] Date of Patent: Nov. 16, 1999

[54] INDUCTION COIL AND CORELESS INDUCTION FURNACE EMPLOYING SAME

[75] Inventors: Oleg S. Fishman, Maple Glen, Pa.; John H. Mortimer, Mt. Laurel, N.J.; Vitaly A. Peysakhovich, Moorestown, N.J.; Satyen N. Prabhu, Voorhees, N.J.; Laurence A. Krupnick, Huntingdon Valley, Pa.

[73] Assignee: Inductotherm Corp., Rancocas, N.J.

[21] Appl. No.: 08/797,148

[22] Filed: Feb. 10, 1997

[51] Int. Cl.[6] ..... H05B 6/44

[52] U.S. Cl. ..... 373/152; 373/153; 219/674

[58] Field of Search ..... 373/138, 139, 373/146, 147, 151, 152, 153, 154, 155, 156; 219/672, 674, 675, 676

[56] References Cited

U.S. PATENT DOCUMENTS

| | | | |
|---|---|---|---|
| 2,182,819 | 12/1939 | Pisarev | 373/152 |
| 2,755,326 | 7/1956 | Kennedy | 373/152 |
| 3,679,807 | 7/1972 | Carcey | 373/152 |
| 5,247,539 | 9/1993 | Gillhaus | 373/153 |
| 5,430,758 | 7/1995 | Gillhaus | 373/153 |

*Primary Examiner*—Tu Ba Hoang

*Attorney, Agent, or Firm*—Seidel, Gonda, Lavorgna & Monaco, PL

[57] ABSTRACT

An induction coil for inductively heating electrically conductive materials includes a plurality of individual coil turns, each turn lying in a plane substantially perpendicular to a longitudinal axis of the coil and comprising an electrical conductor formed into an annulus. The conductor has first and second terminals for connecting the turn to an electrical circuit. The first and second terminals are adjacent each other at a preselected circumferential position on the annulus and are physically and electrically isolated from each other. The first terminal of one turn is located adjacent and electrically connected to the second terminal of an adjacent turn. The first terminal of a selected one of the plurality of turns forms a first coil terminal and the second terminal of a different selected one of the plurality of turns forms a second coil terminal.

24 Claims, 6 Drawing Sheets

INDUCTION COIL AND CORELESS INDUCTION FURNACE EMPLOYING SAME

FIELD OF THE INVENTION

The present invention relates to induction heating and melting apparatus, such as for heating and melting metals, and relates particularly to coreless induction furnaces with an improved coil and magnetic shunt design.

BACKGROUND OF THE INVENTION

Induction heating apparatus such as induction furnaces or ladles for heating or melting metals operate on the principle of inducing eddy currents in an object (sometimes referred to as the load) to be heated. The eddy currents cause the load to act as its own heat source. Power is generated in the load by resistive heating caused by the eddy currents, according to the well-known $P=I^2R$ heating principle. As used herein, "heating" is used broadly to encompass not only raising the temperature of a material without causing the material to change state, but also melting, wherein the temperature of a material is raised sufficiently to cause it to change state.

In a typical induction furnace, metal to be heated is contained in a crucible, and a generally helical induction coil surrounds the crucible. The induction coil is water cooled. The crucible is usually made of a ceramic refractory material. The eddy currents are induced in the load by passing a high-frequency alternating current through the induction coil to generate a time-varying magnetic field, or induction field. Depending upon the magnitude and frequency of the alternating current in the induction coil, and on other design considerations, the induction field can be used for melting, heating, and/or stirring a quantity of molten metal in the crucible. The induction field can also be used for heat treating workpieces, and for other procedures.

In virtually all coreless induction furnaces, the induction coil is constructed of several turns of heavy wall copper tubing shaped into the form of a helix. Alternating electrical current is conducted through the coil via termination tubes connected to the top and bottom turns of the coil. Heat generated in the coil turns is removed by water pumped through the copper tubing. Often, the same termination tubes are used to connect the coil to both a cooling water supply and a source of electrical current. As a practical matter, the termination tubes usually are located near each other at one end of the coil.

The coil is preferably made from one continuous length of copper tubing, or sections of tubing welded or brazed into one continuous length. One drawback of this method of construction is that is does not have great hoop strength. Another is that it is necessary to maintain large inventories of copper tubing for making coils, and to have machinery for winding the copper tubing (which is often of large diameter) into a helical shape. Welding or brazing lengths of copper tubing together to make a large enough coil present readily apparent disadvantages of their own.

The pitch of the helical winding, especially when large diameter tubing is used in high power furnaces, causes complications in mounting the coil in the furnace, which has flat top and bottom surfaces.

In conventional helically wound induction coils, current flows from the bottom turn to the top turn (or vice versa) and the returns vertically down (or up) via the termination tube to the bottom (or top) turn. While the magnetic field $H_c$ of the coil windings is concentrated inside the furnace in the direction of the axis of the coil, the magnetic field $H_t$ of the current in the termination tube is spread in the area around the tube in the plane of the coil turns. This stray magnetic field induces eddy currents in surrounding metal objects, causing them to become heated.

SUMMARY OF THE INVENTION

One aspect of the invention is an induction coil for inductively heating electrically conductive materials. The induction coil comprises a plurality of individual coil turns, each turn lying in a plane substantially perpendicular to a longitudinal axis of the coil and comprising an electrical conductor formed into an annulus. The conductor has first and second terminals for connecting the turn to an electrical circuit. The first and second terminals are adjacent each other at a preselected circumferential position on the annulus and are physically and electrically isolated from each other. The first terminal of one turn is located adjacent and electrically connected to the second terminal of an adjacent turn. The first terminal of a selected one of the plurality of turns forms a first coil terminal and the second terminal of a different selected one of the plurality of turns forms a second coil terminal.

Another aspect of the invention is an induction furnace comprising a refractory vessel for holding a quantity of electrically conductive material to be heated, an induction coil generally surrounding the vessel for inductively heating electrically conductive material in the vessel, and a plurality of magnetic shunt assemblies arranged circumferentially around the induction coil for directing magnetic flux generated by the induction coil to the material to be heated in the vessel. The induction coil comprises a plurality of individual coil turns, each turn lying in a plane substantially perpendicular to a longitudinal axis of the coil and comprising an electrical conductor formed into an annulus. The conductor has first and second terminals for connecting the turn to an electrical circuit. The first and second terminals are adjacent each other at a preselected circumferential position on the annulus and are physically and electrically isolated from each other. The first terminal of one turn is located adjacent and electrically connected to the second terminal of an adjacent turn. The first terminal of a selected one of the plurality of turns forms a first coil terminal and the second terminal of a different selected one of the plurality of turns forms a second coil terminal.

Yet another aspect of the invention resides in the magnetic yokes used with the induction furnace according to the invention. The furnace includes a plurality of magnetic yokes arranged at axially opposite ends of the induction coil and a plurality of magnetic shunts arranged circumferentially around the induction coil. Each magnetic shunt comprises a plurality of laminations arranged in a stack. Each lamination has lateral edges facing the induction coil and lying along a portion of the circumference of a circle having a diameter substantially equal to the outer diameter of the induction coil turns, and each lamination has ends adjacent corresponding axially opposite ends of the induction coil. At least one clamp is provided for holding the laminations in said stack. A cast aluminum heat sink surrounds the stack except for the lateral edges and ends of the laminations.

These and other aspects of the invention will be apparent from the following description and the appended claims.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
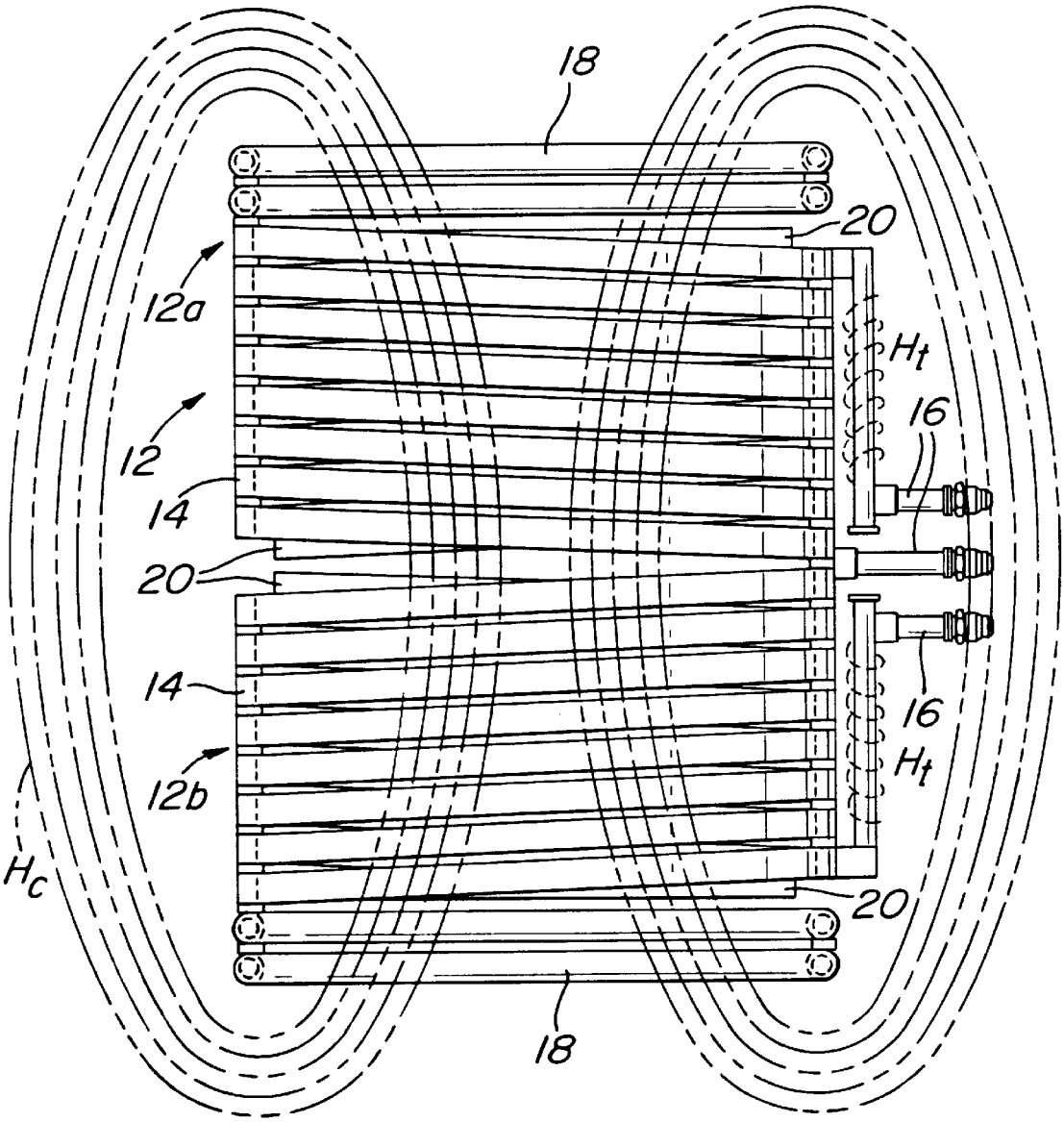
FIG. 1 PRIOR ART
FIG. 1 illustrates a conventional helically wound induction coil for a coreless induction furnace according to the prior art.

Referring now to the drawings, wherein like numerals indicate like elements, there is shown in FIG. 1 an induction furnace 10 with a conventional helically wound induction coil 12 as is known in the art. Induction coil 12 as illustrated in FIG. 1 is a conventional two section coil, comprising oppositely wound top section 12*a* and bottom section 12*b*, but induction coil 12 could equally consist of a single section. As discussed above, induction coil 12 is constructed of heavy wall copper tubing wound helically into a plurality of turns 14. AC electric current is connected to each section of the induction coil by means of termination tubes 16 connected to the top and bottom turns of the coil. The sections of the coil which are supplied with AC current are often referred to as the "active windings." The coil turns 14 are electrically isolated from each other, and are isolated from the termination tubes 16 as well. Heat generated by the flow of AC current in the active windings is removed by water pumped through the copper tubing. Often, termination tubes 16 are used to connect the active windings to both the AC current and a source of cooling water.

Although it is omitted from FIG. 1 for clarity, those skilled in the art will understand that a refractory vessel or crucible is placed inside the helically wound induction coil 12. The crucible holds metal to be inductively heated by induction coil 12. Also omitted for clarity is the furnace shell, which surrounds and supports the coil 12, the crucible, and the other furnace elements. Typically, the furnace shell is metal, and the furnace may also include other metal components.

Induction coil 12 generates an electromagnetic field $H_c$, illustrated by the broken lines in FIG. 1. Usually, a magnetic assembly comprising circular yokes and vertical shunts (omitted from FIG. 1 for clarity) are placed around the outer circumference of induction coil 12. The vertical shunts are made of thin laminations of electromagnetic steel, similar to a transformer coil. The laminations are clamped into a sold stack by one or more "U"-shaped or "C"-shaped brackets made of a non-magnetic metal, such as stainless steel, aluminum, or copper alloys. The surface of the lamination stacks facing the induction coil 12 are typically curved to follow the contour of the outer circumference of the coil 12. This is done by supporting the laminations in a stack such that the surfaces of the laminations which face the induction coil 12 are parallel to and have the same curvature as the outer circumference of coil 12. The sides of the shunts not facing the coil are protected from stray magnetic flux by non-magnetic copper or aluminum side plates. The side plates may be water-cooled to remove excess heat.

Often, the magnetic assembly extends axially above and below the top and bottom of the induction coil 12 to capture magnetic flux which curves around the ends of the coil 12 and direct that flux into the interior of the coil to improve the coupling efficiency of the coil 12 to an object being inductively heated by the coil 12. In such cases, additional turns 18 may be wound above and below the active windings. The additional turns 18 are not connected to the AC current, but are used to support the refractory crucible in the area where the magnetic yokes extend above and below the active windings. These additional turns are often referred to as "cooling turns."

As noted above, the pitch of the helically-wound induction coil 12 causes complications in mounting the coil 12 in the furnace, which has flat top and bottom surfaces. To compensate for the tilt of the coil turns 14 due to the pitch, support fins 20, typically metallic, are welded to the top and bottom turns of each coil section 12*a* and 12*b*. When the induction coil 12 consists of two oppositely wound sections 12*a* and 12*b*, as illustrated in FIG. 1, fins 20 are required in the center of the furnace also, between the two coil sections. Since the fins 20 are metallic and are welded to the coil turns, they will conduct current and therefore generate heat. To remove that heat, the fins 20 need to be water cooled.

Also as noted above, current in the helically wound induction coil 12 flows in the vertical portions of the termination tubes 16, and that current generates a magnetic field $H_t$ around the termination tubes. While the magnetic field $H_c$ generated by the active windings of induction coil 12 is concentrated inside the furnace 10 along the axial direction of the coil 12, the magnetic field $H_t$ around the termination tubes 16 spreads out in the area around the tubes in the plane of the turns 14. Magnetic field $H_t$ induces eddy currents in surrounding metal objects, such as the furnace shell, causing them to become heated.

Still further, the magnetic field $H_t$ which crosses the cooling turns 18 at each end of the induction coil 12 induces eddy currents in the cooling turns, causing additional losses which contribute to reduced furnace efficiency.

Figure 2:
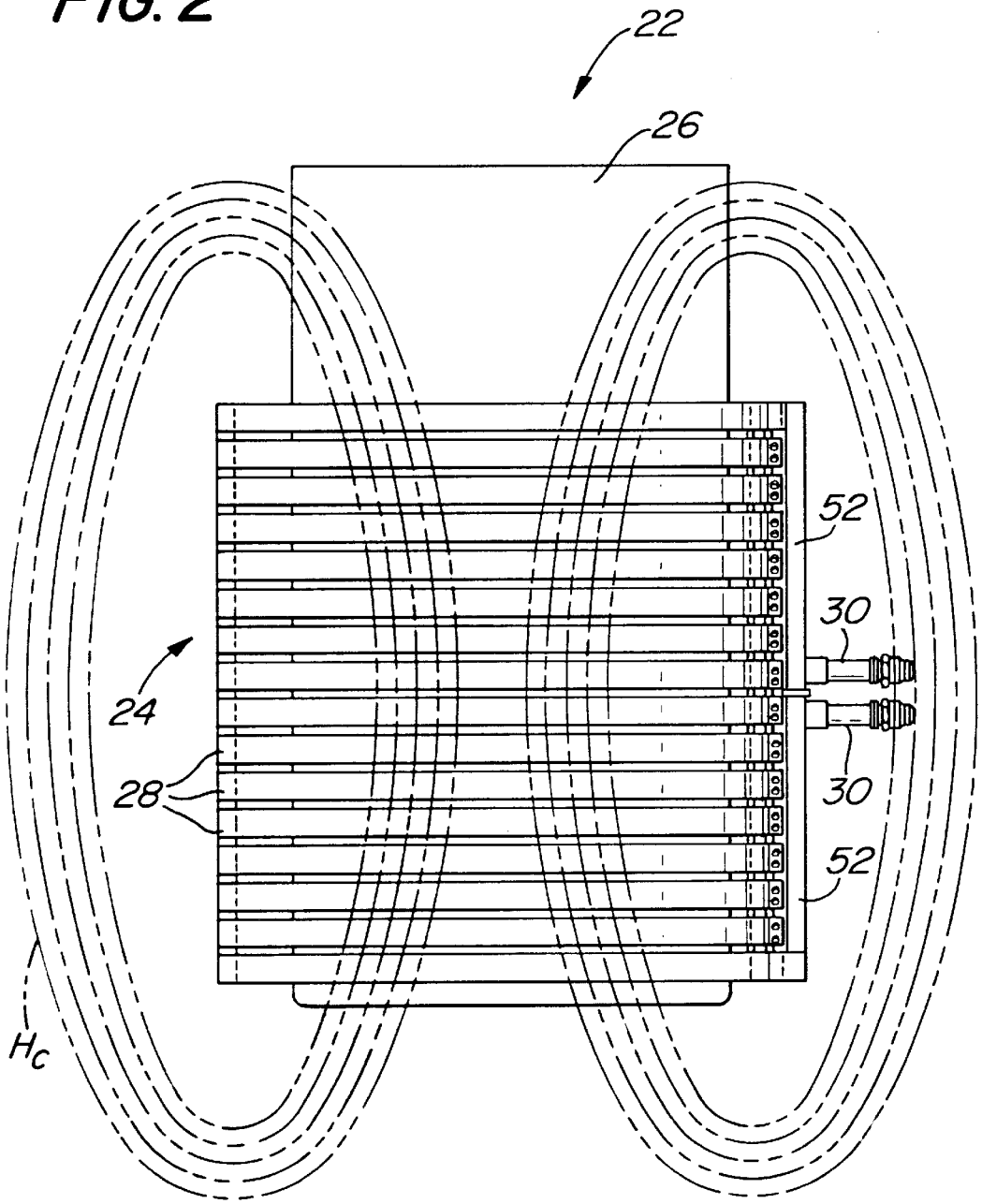
FIG. 2 illustrates an induction coil according to the present invention.

These problems can be eliminated by the induction coil of the present invention. A furnace 22 incorporating an induction coil 24 according to the present invention is illustrated in FIG. 2. As with the furnace 10 illustrated in FIG. 1, some of the non-essential details of the furnace 22 are omitted from FIG. 2 for the sake of clarity. However, those skilled in the art will have no trouble understanding the invention in spite of those omissions.

Furnace 22 comprises induction coil 24 and a refractory vessel or crucible 26 located inside induction coil 24. The crucible holds metal to be inductively heated by induction coil 24. Omitted for clarity is the furnace shell, which surrounds and supports the coil 24, the crucible 26, and the other furnace elements. Induction coil 24 is illustrated as a single section coil, although it is within the scope of the invention for induction coil 24 to comprise two or more sections. As with conventional induction coil 12, induction coil 24 has a plurality of turns 28, and electrical and cooling water connections are made to coil 24 via termination tubes 30. Termination tubes 30 are essentially of the same construction as termination tubes 16 known in the art and, as in the prior art, connect opposite ends of induction coil 24 to an electrical current source and a source of cooling water.

Induction coil 24 differs from conventional induction coil 12 most prominently with respect to how the individual turns 28 are formed. Instead of being wound from a continuous length of copper tubing, induction coil 24 is made up of a plurality of discrete, individual turns 28 of copper tubing formed into a flat annulus, or ring, which are connected together to form a complete coil 24. An individual turn 28 is illustrated in a top plan view in FIG. 6. Turn 28 is circular in shape, and has any desired inner diameter, outer diameter, tubing diameter, and tubing wall thickness. Those dimensions can be determined by the coil designer depending on the particular application of the coil 24, and do not differ materially from the design considerations for conventional induction coils.

Figure 7:
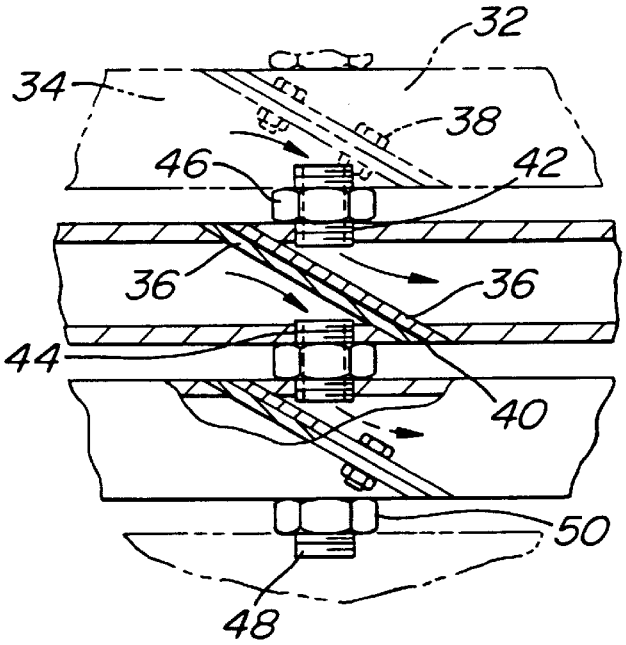
FIG. 7 is a side view of a portion of an induction coil according to the present invention, partially in section, illustrating how coolant flows from one coil turn to another.
Figure 6:
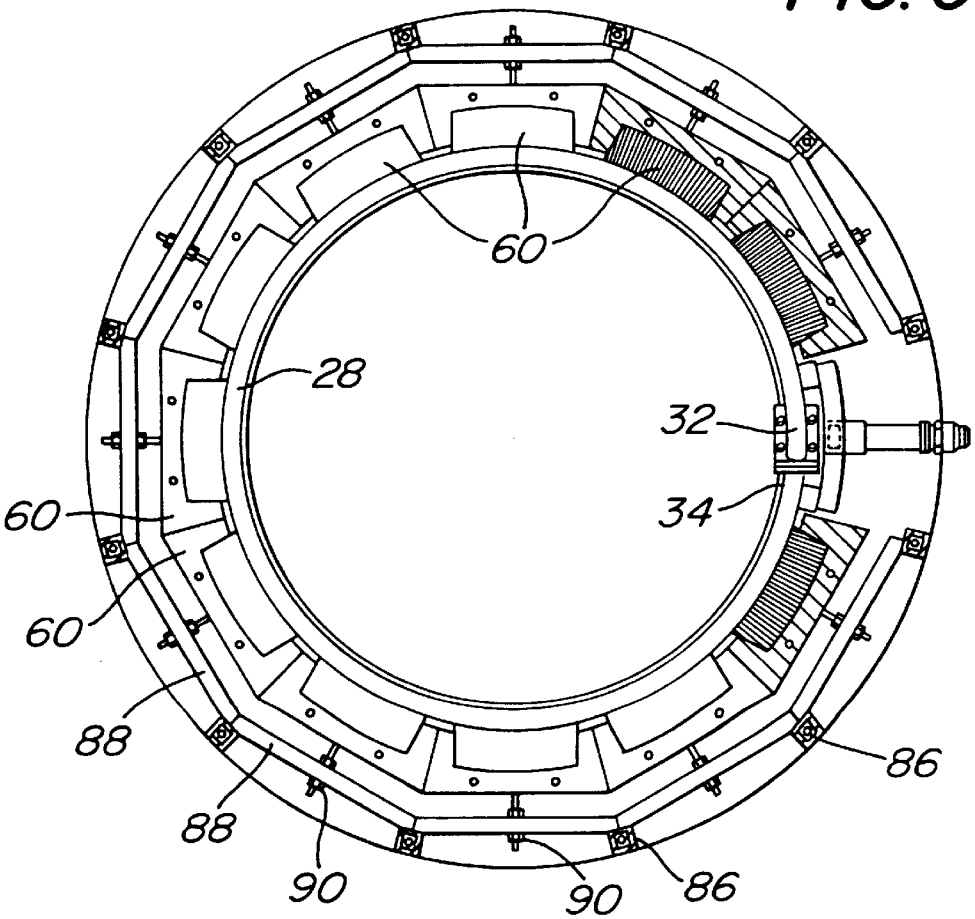
FIG. 6 is a transverse sectional view taken along the lines 6—6 in FIG. 3, and illustrating a magnetic shunt arrangement for directing magnetic flux generated by the induction coil.

As seen in FIG. 2, each turn 28 is flat, or planar, so that the individual turns 28, when connected together to make up a complete coil 24, form a coil in the shape or a right circular cylinder instead of a helix. Each turn has two ends 32 and 34 which overlap and are joined together at an overlap joint at a selected circumferential position on the annulus, as best seen in FIGS. 6 and 7. Each end 32 and 34 is sealed by a plate 36 so that, when the ends 32 and 34 overlap, plates 36 prevent communication between the interior of the tubing at ends 32 and 34 across the overlap joint. Plates 36 also serve to mechanically join the ends 32 and 34 together with appropriate fasteners such as a nut and bolt arrangement 38 or other fasteners. A thin electrically insulating layer 40 is located between ends 32 and 34, so that ends 32 and 34 are electrically, as well as physically, isolated from each other. Thus, when ends 32 and 34 are connected to an electrical current source, current will flow from one end of the turn to the other. It can be seem that this construction provides a turn which is flat, and which is a mechanically closed but electrically open circle.

Each turn 28 has two flow openings 42 and 44 by means of which a coolant, such as coiling water, can be supplied. As illustrated by the arrows in FIG. 7, the coolant entering the tubing making up the turn through opening 42 encounters the plate 36 closing end 32, and is directed to the right as viewed in the figure. The coolant circulates through the turn until it reaches the plate closing end 34. When the coolant encounters plate 36 closing end 34, it is directed out of the tubing making up turn 28 through opening 44. Thus, the coolant makes one "round trip" through the turn before exiting.

Two or more turns 28 may be connected together at their flow openings 42 and 44 by connectors 46. Each connector 46 comprises a short length of pipe 48 which has a center portion 50 in the shape of a hex nut, so that the connector can be turned by a wrench. (Although the connector 46 as described and illustrated is assumed to be a one-piece connector, it is not so limited, and may be made up of more than one piece.) The outer diameter portions of pipe 48 which extend axially from center portion 50 are threaded to engage corresponding threads in flow openings 42 and 44 in turn 28. The threads on the outer diameter portions of pipe 48 have opposite senses, however, i.e., one is right-handed and the other is left-handed, so that when two turns are to be connected by connector 46, rotation of the connector in the clockwise sense threads connector 46 into both turns simultaneously and rotation in the counterclockwise sense threads connector 46 out of both turns simultaneously (or vice versa).

Pipe 48, being hollow, enables coolant to flow from the outlet flow opening 44 of one turn 28 to the inlet flow opening 42 of the adjacent turn 28. Thus, connector 46 provides a mechanical and fluid flow connection between adjacent turns. Connector 46 is conductive, so that it also provides an electrical connection between adjacent turns.

When the desired number of turns are connected to form a coil 24, electrical and coolant connections are made at the turns 28 located at opposite ends of the coil. For example, as shown in FIGS. 2 and 4, termination tubes 52 may be connected to the top and bottom turns of the coil using connectors 46. Termination tubes would otherwise be the same as the termination tubes 16 known in the art. Since each turn 28 of the coil 24 is flat, the resulting coil is in the shape of a right circular cylinder. This makes it very simple to mechanically support the coil, as shown in FIG. 3.

Figure 3:
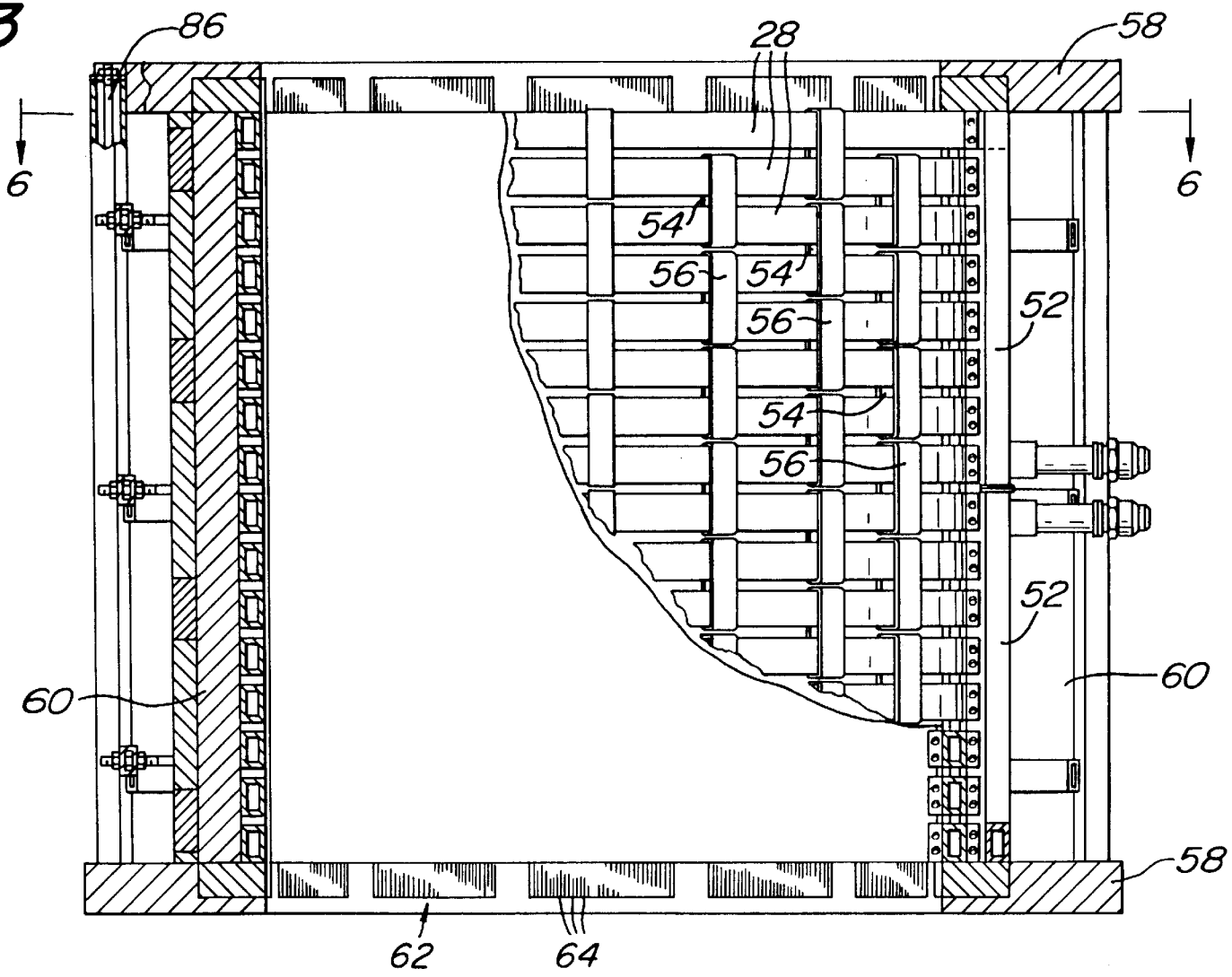
FIG. 3 is a partial sectional view of a coreless induction furnace incorporating an induction coil according to the present invention.
Figure 4:
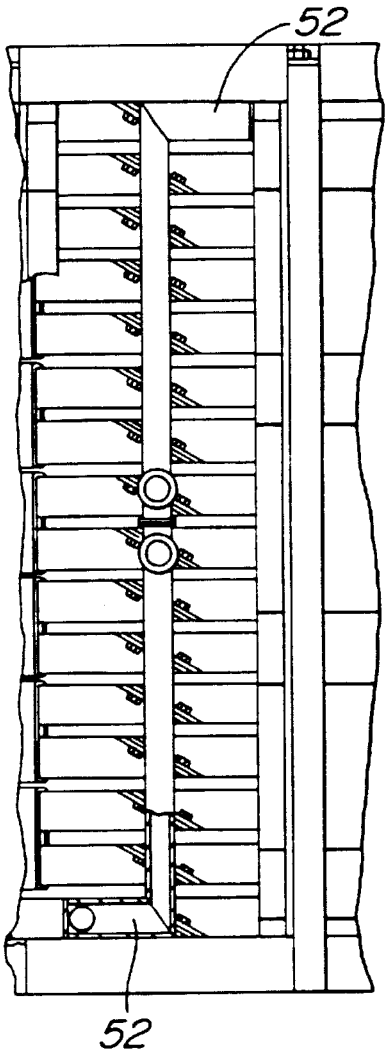
FIG. 4 is a side elevational view, partially in section, of a portion of a coreless induction furnace incorporating an induction coil according to the present invention, showing how individual coil turns are interconnected.
Figure 5:
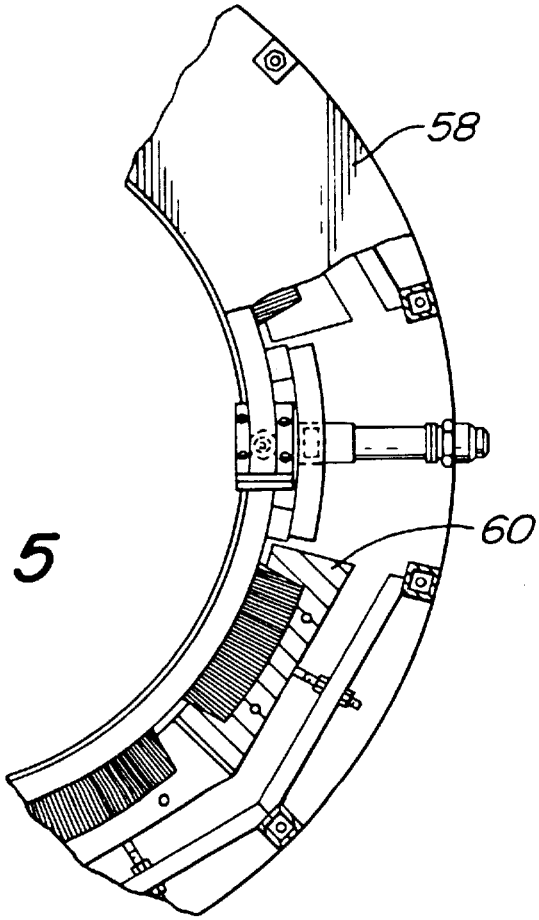
FIG. 5 is a top plan view, partially broken away, of the coreless induction furnace illustrated in FIG. 3.

As shown in FIG. 3, the turns 28 are supported by insulating spacers 54 between adjacent turns. Alternating pairs of turns are held together by straps 56. Preferably, straps 56 comprise several wraps of KEVLAR tape or other insulating tape which has a high tensile strength. However, as those skilled in the art will appreciate, other ways of supporting and mounting the turns may be used without departing from the scope of the invention.

As illustrated in FIG. 2, the magnetic field $H_c$ of coil 24 extends outside the coil for some distance. The field outside the coil can be problematic and interfere with external equipment, and at the very lease leads to furnace inefficiencies. To solve that problem, a magnetic system comprising magnetic yokes and shunts is used. The magnetic system provides a low reactance return path for the magnetic field outside the coil. The magnetic system comprises composite yokes 58 placed at the top and bottom of the coil 24, and a plurality of vertical shunts 60 magnetically connecting the yokes 58.

As best seen in FIG. 3, circular yokes 58 comprises a plurality of rectangular packs 62 of transformer iron laminations 64. The number of packs is equal to the number of vertical shunts 60. The yokes 58 are fabricated by placing the lamination packs 62 into a circular mold. If desired, copper cooling tubes (not shown) can also be placed in the mold. The copper cooling tubes, if used, would have appropriate terminations for connecting the tubes to a source of coolant. After the lamination packs 62 and cooling tubes, if desired, are placed in the mold, the mold is filled with molten aluminum. Once the aluminum solidifies, the circular yoke is removed from the mold.

Figure 8:
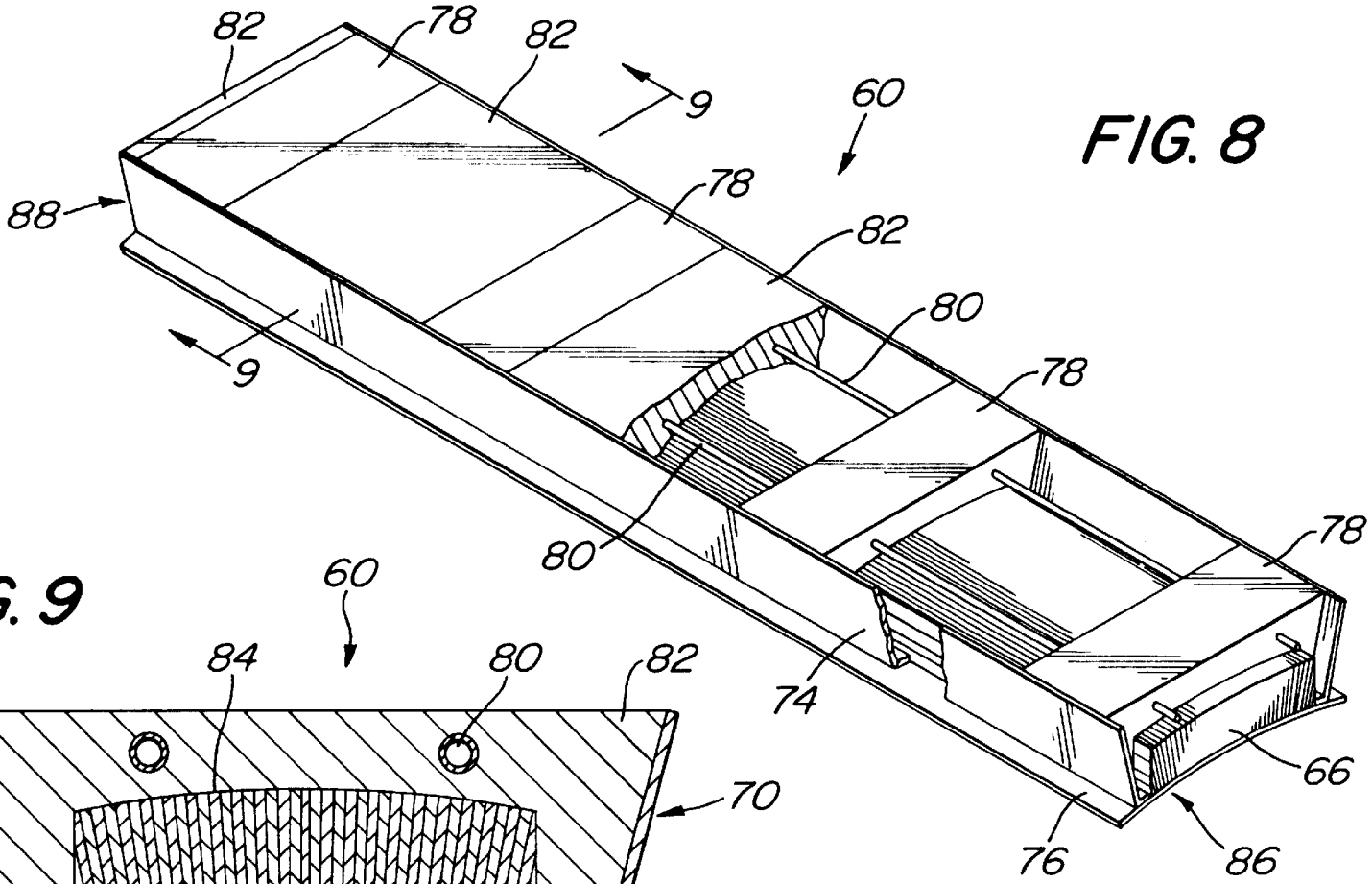
FIG. 8 is an isometric view of one of the magnetic shunt assemblies illustrated in FIG. 7.
Figure 9:
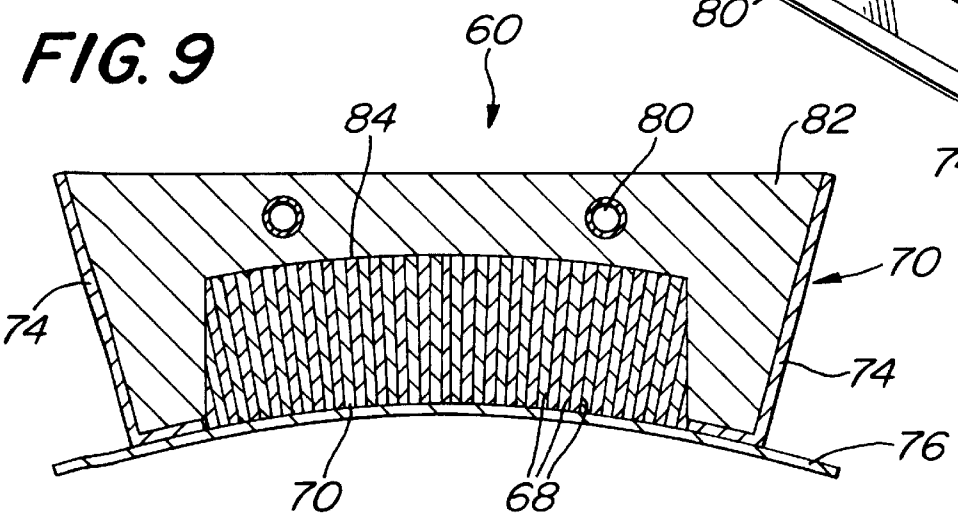
FIG. 9 is a sectional view of the magnetic shunt assembly of FIG. 8, taken along the lines 9—9 in FIG. 8.

The vertical shunts 60, best seen in FIGS. 8 and 9, like the yokes 58, comprise packs 66 of iron laminations 68. The laminations 68 have a length equal to the axial length of the induction coil 24. The shunts 60 are fabricated by clamping the laminations 68 to form packs 66. As the laminations are clamped, they are arranged so that the edges 70 of the laminations which will face the induction coil 24 follow a curvature substantially equal to the outer diameter of the coil. To facilitate this arrangement, the laminations are placed in a specially designed mold 70 which has side walls 74 and a curved guide plate 76 which is used to support the laminations 70 and provide the desired curvature. The widths of laminations 68 at the ends of the pack 66 may be trimmed, if necessary, to have the inner edges 70 conform to the curvature of the guide plate 76. Once the laminations 68 are in place, they are held in place by clamps 78. If desired, copper cooling tubes 80 are located along the length of shunts 60, and are inserted through holes in clamps 78. The ends of cooling tubes 80 are provided with terminations by which they may be connected to a source of coolant. Once all of the laminations, clamps, and cooling tubes are in place, the mold 70 is filled with molten aluminum. Once the aluminum 82 solidifies, shunt 60 is complete.

Although not shown in the figures, the ends of the mold 70 are arranged so that the molten aluminum covers only the lateral sides of the lamination pack 66 and the side 84 that faces away from the induction coil 24. The ends 86 and 88 and the side that faces the induction coil remain exposed.

As best seen in FIG. 3, the yokes 58 are placed at both ends of the induction coil 24 and are then connected together by tie rods 86. The tie rods 86 are located at regular intervals around the circumference of the yokes 58, as can be seen in FIG. 6. The tie rods 86 connect the two yokes 58 and compress the coil turns 28 between the yokes 58 to minimize turn movement and coil vibration when in use. Once the coil turns 28 are properly compressed, the shunts 60 are placed circumferentially around the coil 24, with the guide plate 76 facing the coil. The shunts 60 are placed so that the lamination packs 66 of the shunts 60 are in alignment with the lamination packs 62 of circular yokes 58. The shunts 60 are held in place by a system of horizontal bars 88, through which compression rods 90 are inserted. One end of the compression rods 90 bears against the cast aluminum portion 82 of the shunts 60. Tightening the compression rods 90 holds the shunts 60 in place and compresses the induction coil 24 in the radial direction.

The entire induction coil 24 and magnetic yoke and shunt assembly may be mounted in either a steel shell or a steel frame furnace body.

It will be appreciated from the foregoing description that the induction coil of the present invention and the induction furnace constructed using the coil provide several advantages. The coil is almost exactly in the shape of a right circular cylinder. This simplifies mounting the coil in the furnace body. Each coil turn can be manufactured separately, eliminating the need to inventory tube stock and to handle a heavy, one piece coil until final assembly. The electrical current ascends the coil from turn to turn via the connectors 46, all of which are in a line along the coil circumference, instead of being distributed along the winding. The electrical current in the termination tubes flows in the direction opposite to the electrical current in the connectors, which minimizes stray magnetic fields due to current flow in the termination tubes. Since the individual turns are fabricated separately, they can be made in different sizes and connected together as desired when constructing a coil. Thus, the top and bottom turns may have different dimensions (such as cross section) to minimize losses. Moreover, no cooling turns are needed. Since the magnetic system is molded from aluminum, heat generated in the laminations of the yokes and shunts is very efficiently conducted to the cooling tubes for heat removal. The coil and magnetic assembly is self-contained and is independent of the design of the furnace body.

Other advantages and benefits of the invention will suggest themselves to those skilled in this art.

The present invention may be embodied in other specific forms without departing from the spirit or essential attributes thereof and, accordingly, reference should be made to the appended claims, rather than to the foregoing specification, as indicating the scope of the invention.

We claim:

1. An induction coil for inductively heating electrically conductive materials, comprising a plurality of individual, discrete rings, each ring being substantially circular, serving as an electrical conductor and divided into first and second terminals separated by an insulating element physically and electrically isolating the first terminal and the second terminal thereby forming an electrical discontinuity about the ring, the ring incorporated into an electrical circuit by means of the first and second terminals, the first and second terminals being at a preselected circumferential position on the ring, the first terminal of one ring being adjacent and electrically connected to the second terminal of an adjacent ring.

2. An induction coil as recited in claim 1, wherein each ring lies in a plane substantially perpendicular to a longitudinal axis of the coil.

3. An induction coil as recited in claim 1, wherein the first terminal of a selected one of the plurality of rings serves as a first terminal of the coil and the second terminal of a different selected one of the plurality of rings serves as a second terminal of the coil.

4. An induction furnace comprising:

a refractory vessel for holding a quantity of electrically conductive material to be heated;

an induction coil generally surrounding the vessel for inductively heating electrically conductive material in the vessel, the coil comprising a plurality of individual discrete rings, each ring being substantially circular, serving as an electrical conductor and divided into first and second terminals separated by an insulating element physically and electrically isolating the first terminal and the second terminal thereby forming an electrical discontinuity about the ring, incorporated into an electrical circuit by means of the first and second terminals, the first and second terminals being adjacent each other at a preselected circumferential position on the ring, the first terminal of one ring being adjacent and electrically connected to the second terminal of an adjacent ring, and a magnetic assembly arranged around the induction coil for directing magnetic flux generated by the induction coil to the material to be heated in the vessel.

5. An induction furnace according to claim 4, wherein the magnetic assembly comprises a plurality of magnetic yokes arranged at axially opposite ends of the induction coil and a plurality of magnetic shunts arranged circumferentially around the induction coil.

6. An induction furnace according to claim 5, wherein each magnetic shunt comprises a plurality of laminations arranged in a stack, each lamination having lateral edges facing the induction coil and lying along a portion of the circumference of a circle having a diameter substantially equal to the outer diameter of the induction coil turns, each lamination having ends adjacent corresponding axially opposite ends of the induction coil, at least one clamp for holding the laminations in said stack, and a heat sink surrounding the stack except for the lateral edges and the ends of the laminations.

7. An induction furnace according to claim 6, wherein the heat sink comprises cast aluminum.

8. An induction furnace according to claim 7, wherein the cast aluminum heat sink includes at least one passage therein through which a coolant medium may flow.

9. An induction furnace according to claim 8, wherein the passage comprises a copper tube.

10. An induction furnace as recited in claim 4, wherein the first terminal of a selected one of the plurality of rings serves as a first terminal of the coil and the second terminal of a different selected one of the plurality of rings serves as a second terminal of the coil.

11. An induction furnace as recited in claim 4, wherein each ring lies in a plane substantially perpendicular to a longitudinal axis of the coil.

12. An induction furnace comprising a refractory vessel for holding a quantity of electrically conductive material to be heated, an induction coil generally surrounding the vessel for inductively heating electrically conductive material in the vessel, the coil comprising a plurality of individual, discrete, each ring being substantially circular, serving as an electrical conductor and divided into first and second terminals separated by an insulating element physically and electrically isolating the first terminal and the second terminal thereby forming an electrical discontinuity about the ring, the ring incorporated into an electrical circuit by means of the first and second terminals, the first and second terminals being at a preselected circumferential position on the ring, the first terminal of one ring being adjacent and electrically connected to the second terminal of an adjacent ring, and a plurality of magnetic yokes arranged at axially opposite ends of the induction coil and a plurality of magnetic shunts arranged circumferentially around the induction coil, wherein each magnetic shunt comprises a plurality of laminations arranged in a stack, each lamination having lateral edges facing the induction coil and lying along a portion of the circumference of a circle having a diameter substantially equal to the outer diameter of the induction coil turns, each lamination having ends adjacent corresponding axially opposite ends of the induction coil, at least one clamp for holding the laminations in said stack, and a cast aluminum heat sink surrounding the stack except for the lateral edges and ends of the laminations.

13. An induction furnace as recited in claim 12, wherein each ring lies in a plane substantially perpendicular to a longitudinal axis of the coil.

14. An induction furnace as recited in claim 12, wherein the first terminal of a selected one of the plurality of rings serves as a first terminal of the coil and the second terminal of a different selected one of the plurality of rings serves as a second terminal of the coil.

15. An induction coil comprising:

a plurality of electrically conductive coil turns, including at least a first and a last coil turn, each coil turn having a closed starting end and a closed terminating end mechanically joined together and electrically isolated from each other forming a substantially annular shape lying in a plane substantially perpendicular to a longitudinal axis of the induction coil and spatially separated from adjacent coil turns along the longitudinal axis, the plurality of coil turns forming a right cylinder;

an opening in each coil turn, except for the first coil turn, near the starting end;

an opening in each coil turn, except for the last coil turn, near the terminating end; and a plurality of electrically conductive connectors, each connector joining the starting end opening and the terminating end opening of adjacent coil turns, the plurality of coil turns and connectors forming a continuous electrical circuit from the starting end of the first coil turn to the terminating end of the last coil turn.

16. An induction coil as recited in claim 15, wherein the plurality of coil turns are formed from hollow tubing and the connectors are hollow thereby providing a continuous coolant path within a chamber formed in the hollow tubing of each coil turn and an interior space of each of the connectors.

17. An induction coil as recited in claim 15, further comprising first and second electrical connectors, the first electrical connector located near the starting end of the first coil turn and the second electrical connector located near the terminating end of the last coil turn, to provide power to the induction coil.

18. An induction coil as recited in claim 17, further comprising first and second coolant connectors, the first coolant connector located near the starting end of the first coil turn and the second coolant connector located near the terminating end of the last coil turn, to provide coolant to the induction coil.

19. An induction coil as recited in claim 15, further comprising first and second combined electrical and coolant connectors, the first combined connector located near the starting end of the first coil turn and the second combined connector located near the terminating end of the last coil turn, to provide power and coolant to the induction coil.

20. An induction coil as recited in claim 19, further comprising first and second termination tubes, the termination tubes perpendicularly oriented to the plane of each coil turn and located adjacent to the starting and terminating ends of the plurality of the coil turns, each termination tube approximately half the length of the induction coil, the first termination tube connected to the first combined connector and the second termination tube connected to the second combined connector, to provide a source of power and coolant to the induction coil.

21. An induction furnace having a refractory vessel and supporting structure for the vessel comprising:

an induction coil, disposed between the refractory vessel and the supporting structure, comprising a plurality of coil turns, including at least a first coil turn and a last coil turn, each coil turn having a closed starting end and a closed terminating end mechanically joined together and electrically isolated from each other forming a substantially annular shape lying in a plane substantially perpendicular to a longitudinal axis of the induction coil and spatially separated from adjacent coil turns along the longitudinal axis, the plurality of coil turns forming a right cylinder;

an opening in each coil turn, except for the first coil turn, near the starting end;

an opening in each coil turn, except for the last coil turn, near the terminating end; and a plurality of electrically conductive connectors, each connector joining the starting end opening and the terminating end opening of adjacent coil turns, the plurality of coil turns and connectors forming a continuous electrical circuit from the starting end of the first coil turn to the terminating end of the last coil turn.

22. An induction furnace as recited in claim 21, wherein the plurality of coil turns are formed from hollow tubing and the connectors are hollow thereby providing a continuous coolant path within a chamber formed in the hollow tubing of each coil turn and an interior space of each of the connectors.

23. An induction furnace having a refractory vessel and supporting structure for the vessel comprising:

an induction coil, disposed between the refractory vessel and the supporting structure, comprising a plurality of coil turns, including at least a first coil turn and a last coil turn, each coil turn having a closed starting end and a closed terminating end mechanically joined together and electrically isolated from each other forming a substantially annular shape lying in a plane substantially perpendicular to a longitudinal axis of the induction coil and spatially separated from adjacent coil turns along the longitudinal axis, the plurality of coil turns forming a right cylinder;

an opening in each coil turn, except for the first coil turn, near the starting end;

an opening in each coil turn, except for the last coil turn, near the terminating end; and a plurality of electrically conductive connectors, each connector joining the starting end opening and the terminating end opening of adjacent coil turns, the plurality of coil turns and connectors forming a continuous electrical circuit from the starting end of the first coil turn to the terminating end of the last coil turn;

a magnetic system disposed between the induction coil and the supporting structure, the magnetic system comprising a plurality of magnetic shunts arranged circumferentially around the induction coil, each shunt comprising a plurality of laminations arranged in a shunt stack, each shunt stack comprising an interior surface facing the coil and an exterior surface opposed to the interior surface, the interior surface and exterior surface formed substantially by the longitudinal edges of the laminations and parallel to the longitudinal axis;

end surfaces formed substantially by radial edges of the laminations perpendicular to the longitudinal axis; and side surfaces between the interior surface and the exterior surface, the side surfaces and exterior surface embedded in a thermally conductive material;

and magnetic annular yokes, arranged above and below the plurality of magnetic shunts, each magnetic yoke comprising a plurality of laminations arranged in a yoke stack the yoke stacks disposed circumferentially around the yoke adjacent to one of the plurality of magnetic shunts, each yoke stack comprising an interior surface facing the shunts and an exterior surface opposed to the interior surface, the interior surface and exterior surface formed substantially by edges of the laminations perpendicular to the longitudinal axis, the interior surface disposed adjacent to the end surface of the adjacent magnetic shunt to form a magnetic circuit with the shunt stack;

end surfaces formed substantially by the edges of the laminations parallel to the interior and exterior shunt surfaces; and side surfaces between the interior surface and the exterior surface, the side surfaces and the exterior surface embedded in the thermally conductive material.

24. An induction furnace as recited in claim 23, wherein the plurality of coil turns are formed from hollow tubing and the connectors are hollow thereby providing a continuous coolant path within a chamber formed in the hollow tubing of each coil turn and an interior space of each of the connectors.

* * * * *